US005673645A

United States Patent [19]

Bandyopadhyay

[11] Patent Number: 5,673,645

[45] Date of Patent: Oct. 7, 1997

[54] AGILE WATER VEHICLE

[75] Inventor: Promode R. Bandyopadhyay, Barrington, R.I.

[73] Assignee: The United States of America as represented by the Secretary of the Navy, Washington, D.C.

[21] Appl. No.: 627,816

[22] Filed: Apr. 1, 1996

[51] Int. Cl.[6] ..... B63G 8/00

[52] U.S. Cl. ..... 114/312; 114/274

[58] Field of Search ..... 114/312, 314, 114/321, 330–333, 337, 338, 274, 162, 163, 145 R, 126; 440/13–15, 17, 19, 20

[56] References Cited

U.S. PATENT DOCUMENTS

| | | | |
|---|---|---|---|
| 1,372,402 | 3/1921 | Christoff | 440/17 |
| 2,873,710 | 2/1959 | Morel | 114/338 |
| 3,183,871 | 5/1965 | Reder | 114/338 |
| 3,448,710 | 6/1969 | Gaskins | 114/338 |

*Primary Examiner*—Edwin L. Swinehart
*Attorney, Agent, or Firm*—Michael J. McGowan; Prithvi C. Lall; Michael F. Oglo

[57] ABSTRACT

An agile water vehicle for travel above and below the water surface, includes a hull having therein a helmsman's compartment, a payload compartment, and a propulsor unit. A rudder assembly is fixed to the hull and includes a cylindrically-shaped (or slightly tapered) tubular member having a rudder thereon and extending therefrom, the tubular member being rotatable. A wing assembly is fixed to and spaced from a bottom portion of the hull, the wing assembly comprising a pair of wings extending widthwise of the axis of the hull, and a flap adapted for disposal in each of the wings and extendible therefrom, the flaps being operable for pivotal movement upwardly and downwardly from the wings. The propulsor unit, the rudder assembly, and the flaps are operable from the helmsman's compartment. A pair of propulsors are disposed on the wings and are rotatable around the spanwise axis of the wings. A pair of differential flaps are mounted on a rotatable axial cylinder or ring with a fixed divider plate therebetween.

15 Claims, 3 Drawing Sheets

AGILE WATER VEHICLE

STATEMENT OF GOVERNMENT INTEREST

The invention described herein may be manufactured by or for the Government of the United States of America for governmental purposes without the payment of royalties thereon or therefor.

BACKGROUND OF THE INVENTION (1) Field of the Invention

This invention relates to water vehicles and is directed more particularly to an agile water vehicle for travel above and below the water surface and to means for enhancing maneuverability.

(2) Description of the Prior Art

It is known to use submarines for special forces (such as Navy SEALS) rendezvous and deployments, and for intelligence gathering along a shore line. However, the role of a regular deep ocean submarine in the littoral area is necessarily somewhat restricted. There is thus a need for a vehicle whose size is more utilitarian in a littoral context.

Given the redirection of defense concerns from deep ocean interdiction to littoral operations, there is a need for platforms which are able to provide a manned presence in problematic areas and undertake mine detection and neutralization in shallow water areas.

There is thus a need for new vehicles,large or small, manned or unmanned; that are highly maneuverable and capable of performing in the shallow waters of the littoral area.

SUMMARY OF THE INVENTION

Accordingly, an object of the invention is to provide a relatively small and highly maneuverable water vehicle, operable by a person, and capable of transporting a small team of persons, or an even much smaller version of it that is unmanned and serves to locate and neutralize mines in the shallow waters of the littoral areas.

A further object of the invention is to provide such a water vehicle as is capable of travelling above the surface of the water for high speed transits, capable of travelling under the surface of the water for stealth approaches, and capable of floating on the surface for boarding or disembarking personnel, for intelligence gathering, and for overt actions.

With the above and other objects in view, as will hereinafter appear, a feature of the invention is the provision of a water vehicle for travel above and below the water surface. The vehicle comprises a hull having therein a helmsman's compartment, a payload compartment, a propulsor means and various maneuvering devices. The vehicle further comprises a rudder assembly fixed to the hull and comprising a cylindrically-shaped tubular member having a rudder thereon extending outwardly from an outside wall of a rotatable tubular member. The vehicle still further comprises a wing assembly fixed to and spaced from a bottom portion of the hull, the wing assembly comprising a pair of wings extending widthwise of the axis of the hull, and a flap adapted for disposal in each of the wings and extendible therefrom, the flaps being operable for pivotal movement upwardly and downwardly from the respective wings. The propulsor means, rudder assembly and flaps are operable from the helmsman's compartment.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
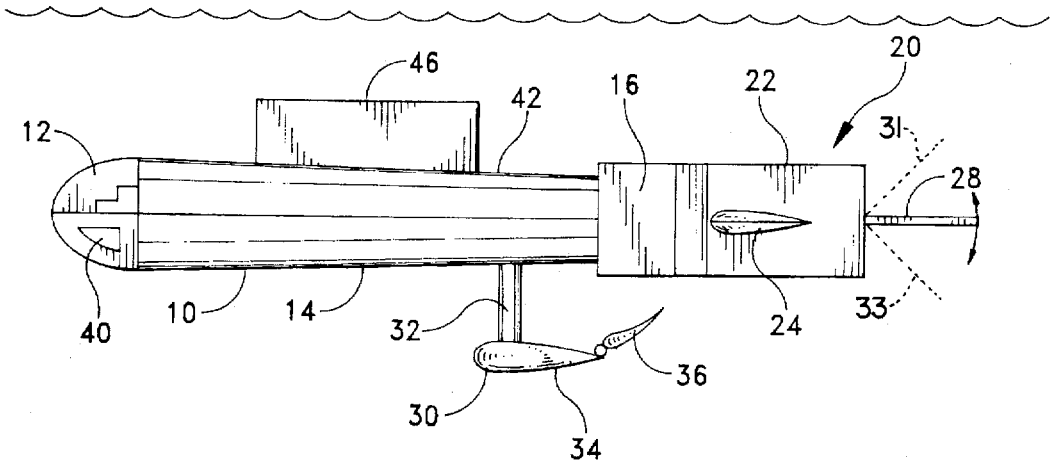
FIG. 1 is a diagrammatic illustration of one form of vehicle illustrative of an embodiment of the invention.
Figure 4:
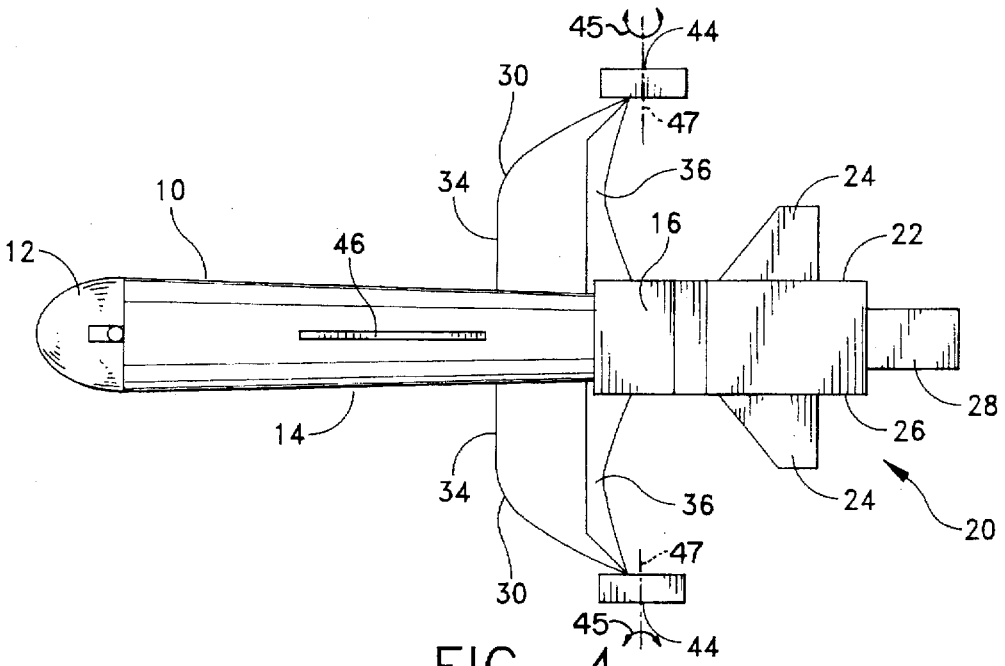
FIG. 4 is a top plan view of the vehicle.

Referring to FIG. 1, it will be seen that the illustrative vehicle includes a slightly tapered hull 10 in the form of a tubular member of slightly tapered diameter and having therein a helmsman's compartment 12 adapted to receive and enclose a helmsman, or operator (not shown), of the vehicle. The hull 10 further includes a payload compartment 14 for receiving surveillance gear, and/or weaponry, and/or mine tagging/neutralization pellets, and/or a team of persons (none shown)or mine tagging/neutralization pellets for dropping. A propulsor means 16 is disposed in hull 10 and is adapted to provide thrust to the vehicle when the vehicle is underwater, as shown in FIG. 4.

A rudder assembly 20 is fixed to hull 10 and includes a cylindrically-shaped tubular member 22 having rudders 24 thereon extending outwardly from an outside wall 26 (FIG. 4) of tubular member 22. Tubular member 22 is rotatably fixed to hull 10, such that tubular member 22 can be rotated on hull 10 as shown in FIG. 4, rudders 24 turning with tubular member 22. Rudder assembly 20 further includes a second rudder 28 fixed to tubular member 22 and extending aft thereof. When tubular member 22 is rotated, rudder 28 turns with the tubular member. Rudders 24, 28 are hingedly fixed to tubular member 22, such that rudders 24, 28 are pivotally movable relative to tubular member 22.

Figure 7:
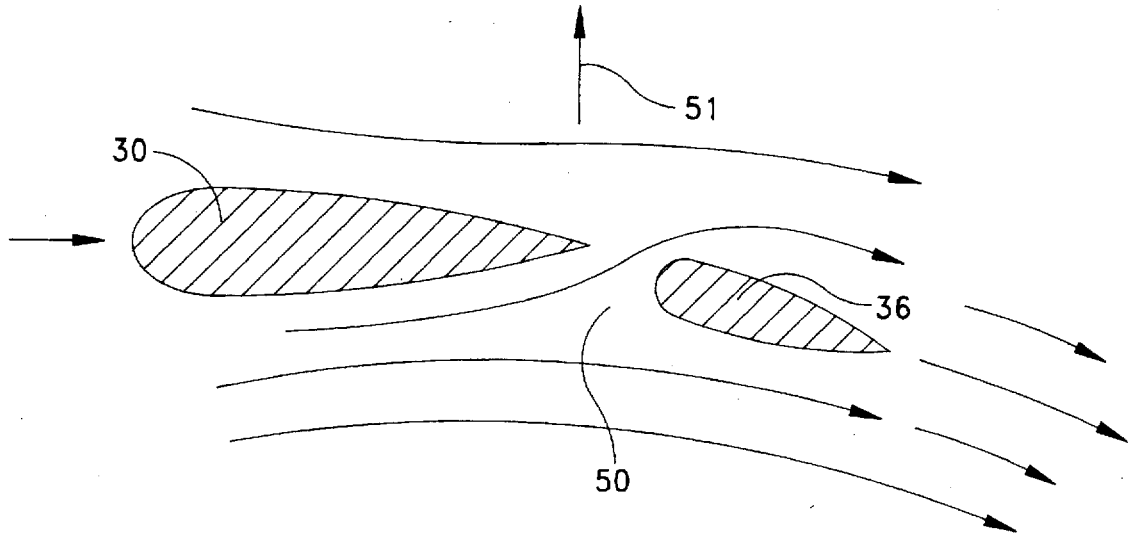
FIGS. 7 and 8 are diagrammatic illustrations of slotted flaps/hydrofoils and wings of the vehicle for enhancing lift forces.
Figure 8:
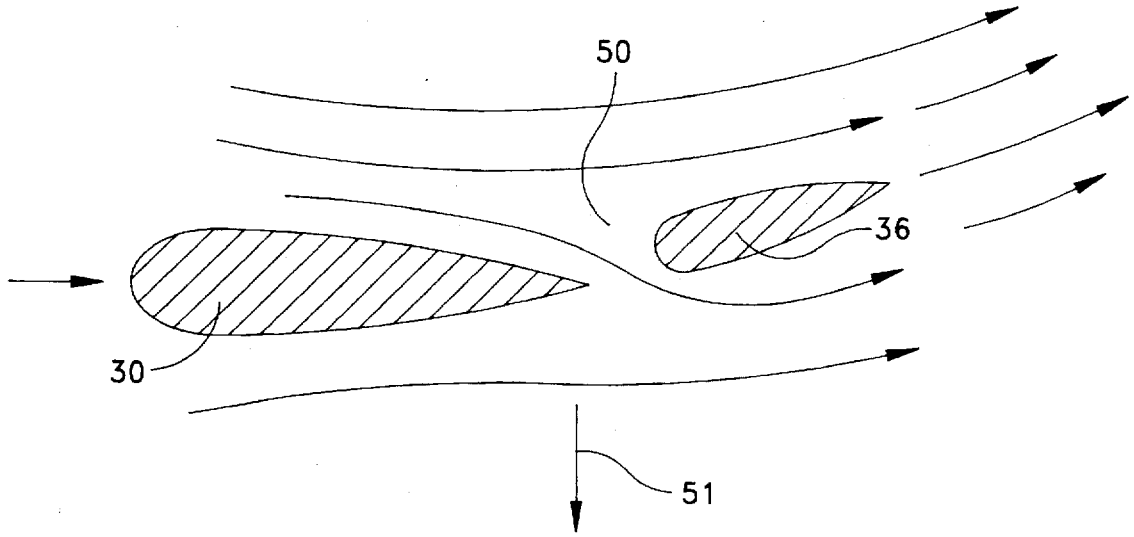

A wing assembly 30 is fixed to hull 10 and spaced from the hull by a strut 32 which extends from a bottom portion of the hull. Wing assembly 30 includes a pair of wings 34 (FIG. 4) extending widthwise of the axis of hull 10. At least one slotted hydrofoil 36 (referred to as a "flap" in aeronautical terminology) is adapted for disposal in each wing 34 and is extendible therefrom. The slotted flaps 36 are pivotally mounted to pivot generally upwardly and downwardly from a forward edge thereof. Their deployment increases the camber of the wing 36 (FIGS. 7 and 8). Their extension and slight turning upward or downward produces lift forces downwards and upwards, respectively. It should be noted that normally slotted flaps 36 are not continuously flapped in a rythmic fashion. The flaps 36 are adapted to be extended in an aft and generally upwardly direction (FIGS. 1 and 8) to provide a force 51 in a downwardly (diving) direction, and are adapted to be extended in an aft and generally downwardly direction (FIGS. 2 and 7) to provide force 51 in an upwardly direction.

The propulsor means 16, rudder assembly 20, and slotted flaps 36 are operable from the helmsman's compartment 12 by either a helmsman or an automatic pilot 40 (FIG. 1) adapted to receive instructions from a remote station and, in response to such instructions, to maneuver the vehicle by control of the rudder assembly 10, flaps 36 and propulsor means 16.

As shown in the drawings, hull 10 is of a generally cylindrical (slightly tapered) configuration. The rudder assembly cylindrically shaped tubular member 22 is roughly of the same outside diameter as hull 10, to provide a sleek continuous outside surface for the vehicle.

Figure 2:
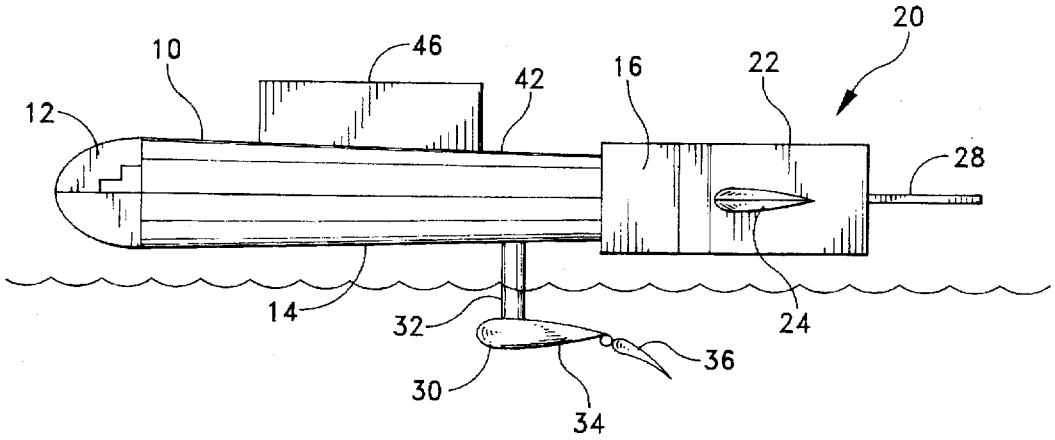
FIG. 2 is similar to FIG. 1, but illustrates the vehicle in a different mode of operation.
Figure 3:
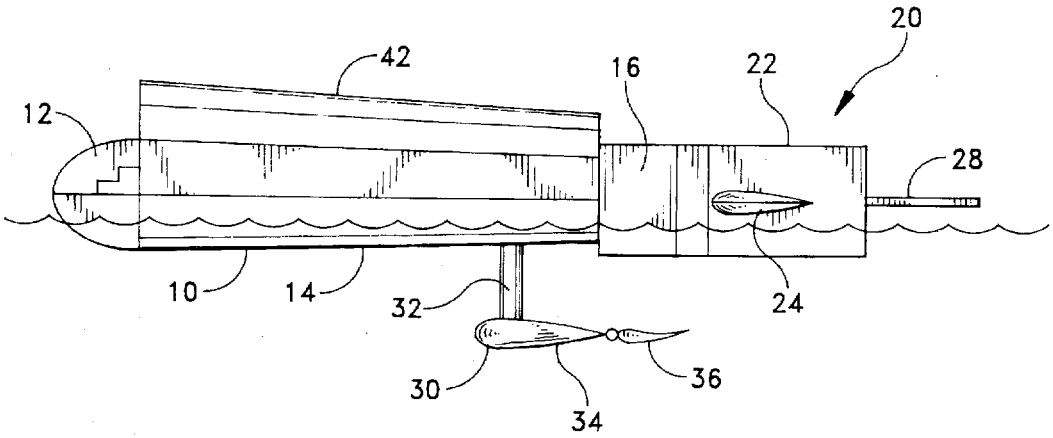
FIG. 3 is similar to FIG. 2, but illustrates the vehicle in still another mode of operation.

Referring to FIG. 3, it will be seen that an upper portion of hull 10 is provided with a hatch 42 which is opened for access to and egress from payload compartment 14, and closed (FIGS. 1 and 2) to provide a water-tight enclosure for personnel and/or equipment.

The vehicle is not provided with a periscope or other such sighting means. The vehicle is intended for shallow water operations, such as adjacent beaches, in bays, rivers, and the like, typically only a few tens of feet below the surface, and is therefore provided with a forward-most bow location for the helmsman's compartment 12, from whence the helmsman can visually ascertain the presence of structures, sand bars, shoals, and the like.

The vehicle is not provided with ballast tanks. The vehicle is simply "driven" to a location below the water's surface and thence forwardly with sufficient downward direction to balance buoyancy. The relative positions of the center of pressure and gravity could be such that the vehicle could be in neutral equilibrium. Conventional "fly-by-wire" can be used to automatically sense imbalance and move the control surfaces and achieve dynamic equilibrium.

For additional thrust and maneuverability, the vehicle may be provided with wing-mounted propulsors 44 (FIG. 4), operable from helmsman's compartment 12, either in unison, or independently. Additional maneuverability can be achieved by fitting the wing-tip propulsors about a spanwise axis. For still greater maneuverability, the vehicle may be provided with a pivotally mounted dorsal fin 46 (FIGS. 1, 2 and 4) which cambering which abruptly facilitates quick or brisk changes of course to port or starboard.

In operation of the manned version, the vehicle is boarded as shown in FIG. 3, while floating on the surface. For example, a helmsman and special forces team enters the vehicle by way of open hatch 42, the helmsman occupying the helmsman's compartment 12 and a 3–5 man team occupying the payload compartment 14. Hatch 42 is closed and secured from inside to render the compartments 12, 14 water-tight.

The slotted flaps 36 are activated to extend aft from the wings 34, as shown in FIG. 4, and extend upwardly, as shown in FIGS. 1 and 8, to provide a downward force 51 to the vehicle, causing the vehicle to be driven beneath the surface. The main propulsor 16 is activated to provide thrust and, if desired, the wing-mounted propulsors 44, to greatly increase thrust and speed.

As the vehicle reaches top speed submerged, flaps 36 are moved to the aft and downwardly extending attitude, shown in FIGS. 2 and 7, driving the vehicle upwardly. In due course, the vehicle breaks the surface, supported by the wings 34, which remain beneath the surface. The vehicle attains its fastest speed in the above-surface mode. In surface mode shown in FIG. 2, the upward lifting force produced jointly by the slotted flap 36 and wings 30 due to the forward thrust provided by the wing-tip propulsors, the main cylinder 10 would no longer be attached to the water surface. If mount aimed at this posture (FIG. 2), the wave drag with be drastically reduced (compared to a ship-like vehicle in contact with surface waves).

Upon approach to the target area, the vehicle may again be submerged, for stealth purposes, and guided by the helmsman utilizing the rudder assembly 20, the wing-mounted propulsors 44, and the dorsal fin 46, for course changes and quick maneuvering to avoid obstacles. Upon securing of all propulsion systems, the vehicle floats to the surface, permitting easy disembarkation of the special forces team.

Figure 5:
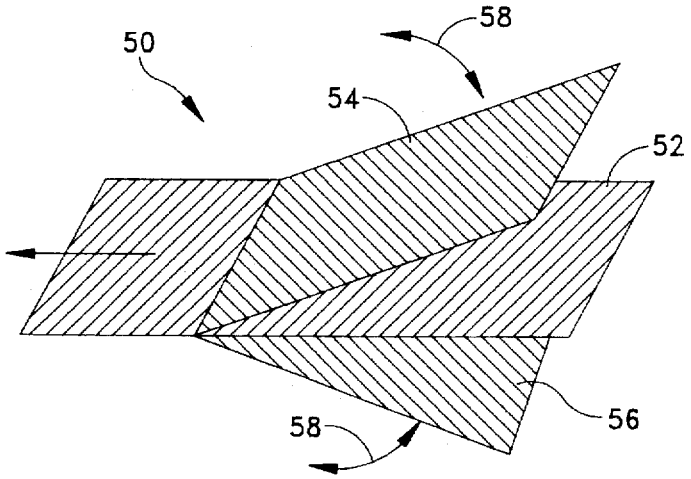
FIGS. 5 and 6 are diagrammatic illustrations of alternative arrangements of maneuvering flaps on the vehicle.
Figure 6:
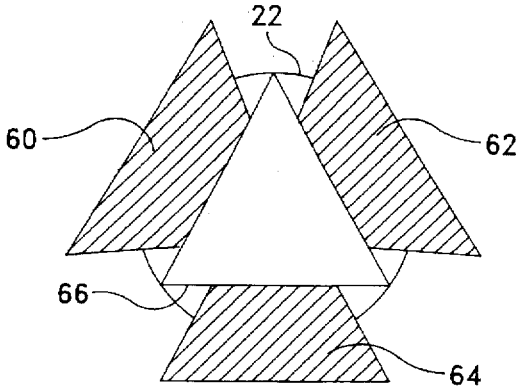

In FIGS. 5 and 6, there are diagrammatically illustrated alternative embodiments of the invention. The rudders 24 and 28, shown in FIG. 5, are replaced by a dual flap assembly 50, including a non-moving divider plate 52 and hingedly mounted flaps 54, 56, movable as denoted by arrows identified by reference characters 58. The flaps 54, 56 may be used simultaneously or individually. Differential flapping of 54 and 56 will produce a net maneuvering force. In FIG. 6, flaps 60, 62, 64 are hingedly mounted on a triangularly shaped divider body 66 fixed in tubular member 22 and extending aft of tubular member 22. Again, flaps 60, 62, 64 may be used differentially. The flaps 54, 56, and also flaps 60, 62 and 64, all mounted on tubular member 22, are usable only in the submerged mode of operation.

In a further alternative embodiment, rhythmically flapping flaps can be installed on wing 30 and slotted flaps 36 for maneuvering, via differential flapping, can be installed in starboard and port sides of the wing assembly 30.

In another embodiment, maneuvering forces are generated by differentially and rhythmically flapping the flaps 36 in the port and starboard sides (FIG. 4). Flaps 36 can be oscillated at different frequencies and amplitudes to generate a net moment to allow the vehicle to roll and turn.

FIGS. 7 and 8 show the streamline patterns of the flow along the wing assembly 30, 34 and flap 36. In this slotted hydrofoil/flap mode, the flap 36 is not being moved up and down rhythmically, but is moved up (FIG. 8) or down (FIG. 7) and is held there. Flap 36 in these situations creates a slotted hydrofoil, the slot being depicted by reference character 50. In FIG. 8, a downward lift force 51 is produced which allows diving. In FIG. 7, the lift force 51 is directed upward. FIGS. 7 and 8 show that the indicated movement of flap 36 virtually creates a highly cambered wing, which has the characteristic of producing high lift forces at low vehicle speeds.

There is thus provided a small and highly maneuverable water vehicle, capable of travelling above the surface of the water for high speed transits, under the surface for stealth approaches, and capable of floating on the surface for easy boarding and disembarkation of personnel, or for intelligence gathering, and/or for covert actions, such as by personnel-carried rocket launchers, or the like.

It is to be understood that the present invention is by no means limited to the particular construction herein described and/or shown in the drawings, but also comprises any modifications or equivalents within the scope of the claims.

What is claimed is:

1. An agile water vehicle for travel above and below the water surface, said vehicle comprising:

a hull, generally a tubular member of slightly tapered diameter, said hull having therein:

a helmsman's compartment;

a payload compartment;

a propulsor means;

a rudder assembly fixed to said hull, said rudder assembly comprising a cylindrically-shaped tubular member having a first rudder thereon extending outwardly from an outside wall of said tubular member, said tubular member being rotatable;

a wing assembly fixed to said hull at a bottom portion thereof and spaced from said bottom portion, said wing assembly comprising a pair of wings extending widthwise of the axis of said hull, and at last one flap adapted for disposal in each of said wings and extendible therefrom to an operable position, said flaps being operable for pivotal movement upwardly and downwardly from said wings, said flaps, when extended and rotated upward or downward creating a slot which effectively increases camber of the wings, said flap, when extended and rotated upward or downward creates a slot which effectively increases the camber of the wing; and said propulsor means, said rudder assembly and said flaps being operable from said helmsman's compartment.

2. The vehicle in accordance with claim 1 wherein said hull is of a generally cylindrical tapered configuration.

3. The vehicle in accordance with claim 1 wherein an upper portion of said hull comprises a hatch closeable to render said hull substantially water-tight and operable to facilitate access to and egress from said payload compartment.

4. The vehicle in accordance with claim 2 wherein said helmsman's compartment is disposed in a bow portion of said vehicle and said payload compartment is disposed aft of said helmsman's compartment.

5. The vehicle in accordance with claim 2 wherein said rudder assembly tubular member is generally of the same outside diameter as an aft end of said hull and is disposed aft of said hull.

6. The vehicle in accordance with claim 1 wherein said vehicle further comprises a propulsor mounted on each of said wings, said wing mounted propulsors adapted to being operable from said helmsman's compartment and adapted to being rotatable about a spanwise axis.

7. The vehicle in accordance with claim 1 wherein said helmsman's compartment is adapted to receive a person for manual operation of said vehicle.

8. The vehicle in accordance with claim 1 wherein said rudder assembly further comprises a second rudder extending aft from an aft end of said tubular and rotatable member.

9. The vehicle in accordance with claim 1 wherein said first rudder is mounted on said tubular member and movable relative to said tubular member.

10. The vehicle in accordance with claim 8 wherein said first and second rudders are mounted on said tubular member and movable relative to said tubular member.

11. The vehicle in accordance with claim 1 wherein said flaps are adapted for said pivotal movement relative to said wings in alternating ones of said upwardly and downwardly directions in a rhythmic fashion to provide at least one of thrust and maneuvering for said vehicle.

12. The vehicle in accordance with claim 11 wherein said flaps are adapted to extend from an aft portion of said wings in an aft and generally upwardly direction, such that said flaps direct said vehicle downwardly, and said flaps are adapted to extend in an aft and generally downwardly direction, such that said flaps direct said vehicle forwardly and upwardly.

13. The vehicle in accordance with claim 1 wherein said at least one flap comprises a flap assembly comprising said one flap, a second flap, and a divider plate extending therebetween, the two flaps being adapted to be operated differentially in amplitude and frequency.

14. The vehicle in accordance with claim 13 wherein said divider plate is non-movable when in said operable position.

15. The vehicle in accordance with claim 1 and further comprising a divider body having at least three walls joined together, said divider body being disposed in and extending aft from said tubular member, and a flap hingedly mounted on each of said divider walls and adapted for pivotal movement alternating toward and away from an adjacent one of said walls, the three flaps being adapted to be operated in a differential manner in amplitude and frequency.

* * * * *